US006993885B2

(12) United States Patent
Glatfelter, Jr.

(10) Patent No.: US 6,993,885 B2
(45) Date of Patent: Feb. 7, 2006

(54) PRINTER FOR SHINGLED BAGS AND METHOD

(75) Inventor: Thomas L. Glatfelter, Jr., Dover, PA (US)

(73) Assignee: Greydon, Inc., York, PA (US)

( * ) Notice: Subject to any disclaimer, the term of this patent is extended or adjusted under 35 U.S.C. 154(b) by 0 days.

(21) Appl. No.: 10/974,059

(22) Filed: Oct. 27, 2004

(65) Prior Publication Data

US 2005/0284105 A1 Dec. 29, 2005

Related U.S. Application Data

(62) Division of application No. 10/880,208, filed on Jun. 29, 2004, now Pat. No. 6,837,023.

(51) Int. Cl.
*B65B 61/26* (2006.01)

(52) U.S. Cl. ..... 53/411

(58) Field of Classification Search ..... 53/411
See application file for complete search history.

(56) References Cited

U.S. PATENT DOCUMENTS

| | | | | |
|---|---|---|---|---|
| 3,190,054 A | | 6/1965 | Arnold et al. | 53/131 |
| 3,358,414 A | * | 12/1967 | Hersh et al. | 53/411 |
| 3,765,326 A | | 10/1973 | Hawkins | 101/44 |
| 3,878,776 A | * | 4/1975 | Schneider | 101/41 |
| 3,881,410 A | | 5/1975 | Shenoha | 101/41 |
| 4,073,117 A | | 2/1978 | Shenoha | 53/14 |
| 4,073,122 A | | 2/1978 | Areson | 53/131.4 |
| 4,334,399 A | | 6/1982 | Onishi | 53/69 |
| 4,336,681 A | | 6/1982 | Onishi | 53/459 |
| 4,393,640 A | | 7/1983 | Cole et al. | 53/69 |
| 4,859,083 A | | 8/1989 | Nocek et al. | 383/37 |
| 4,903,600 A | | 2/1990 | Long | 101/485 |
| 5,371,521 A | | 12/1994 | Wehrmann | 346/76 |
| 6,470,648 B1 | | 10/2002 | Baker | 53/411 |
| 6,543,201 B2 | | 4/2003 | Cronauer et al. | 53/131.5 |
| 6,688,346 B2 | | 2/2004 | Brahier et al. | 141/314 |
| 6,742,317 B2 | * | 6/2004 | Cronauer et al. | 53/411 |
| 2003/0106285 A1 | | 6/2003 | Cronauer et al. | 53/411 |

* cited by examiner

*Primary Examiner*—John Sipos
(74) *Attorney, Agent, or Firm*—Hooker & Habib, P.C.

(57) ABSTRACT

A bagger feeds shingled open-ended bags to a workstation. Each bag is printed with information, typically date and product source information. The print area on each underlying bag is located by flipping up a trailing portion of an overlying bag.

14 Claims, 5 Drawing Sheets

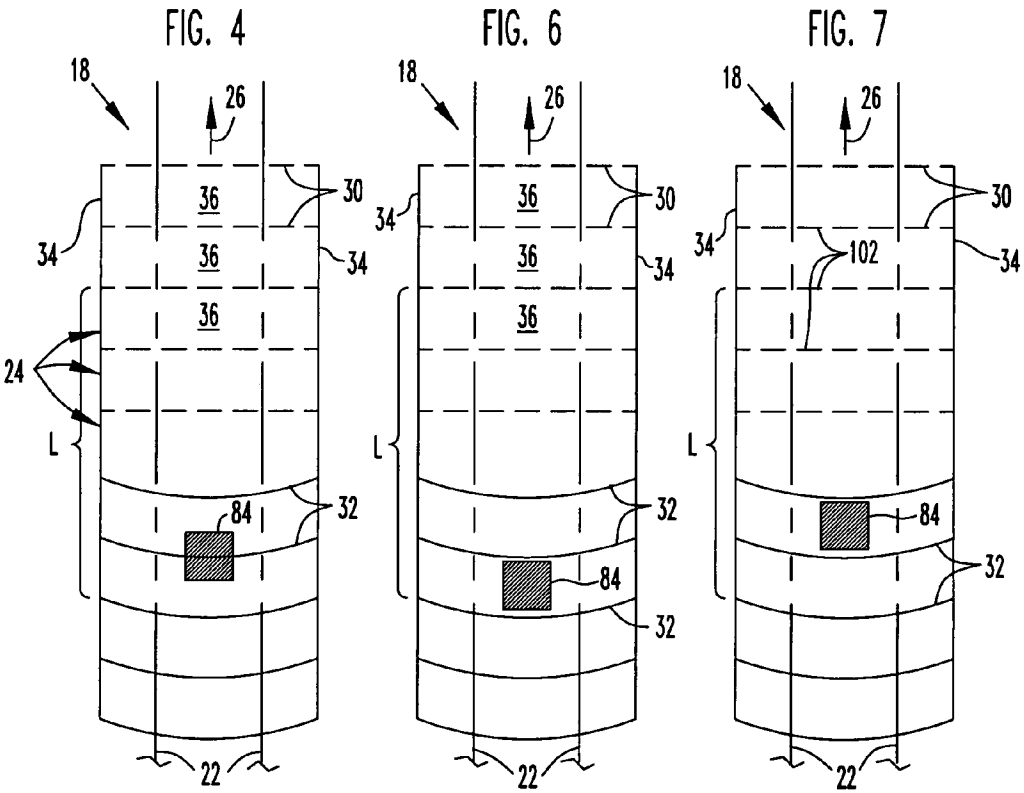
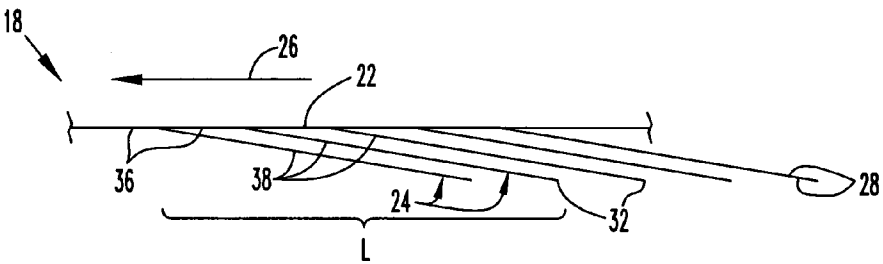
FIG. 5

PRINTER FOR SHINGLED BAGS AND METHOD

This application is a division of my application for Printer For Shingled Bags and Method, Ser. No. 10/880,208 filed Jun. 29, 2004, now U.S. Pat. No. 6,837,023.

FIELD OF THE INVENTION

The invention relates to printers for article baggers of the type in which an indefinite length shingled bag assembly is fed to a workstation, and to related methods.

BACKGROUND OF THE INVENTION

Foods products, such as meat, cheese and the like, are conventionally packaged in plastic bags using an automated bagger. The bagger feeds shingled plastic bags in a bag assembly to a workstation where a lead bag is inflated and an article is inserted into the bag. The bag is then stripped from the bag assembly and sealed. The automated bagger feeds the next bag in the shingled assembly to the workstation, the bag is inflated by an air blast and the cycle is repeated.

Packaged foods products must carry date and product source information. This information is conventionally printed on the bags in the shingled bag assembly before the bags are fed to the workstation and filled. A printer prints information on exposed sides of the bags in the shingled bag assembly. The bags overlap each other so that the surface on a bag exposed for printing extends longitudinally along the bag assembly from the end of an overlying, downstream bag to the end of the bag being printed.

The bag assemblies are manufactured by making plastic bags from plastic film and placing the bags on adhesive strips running the length of the assembly. The bags are not accurately spaced along the length of the assembly. This means that the exposed portions of the bags on the assembly which are printed are unpredictably spaced apart along the length of the assembly.

On conventional baggers feed of the bag assembly is stopped and a printer prints required information on a bag at a print area calculated to be between the end of the bag and the end of the downstream bag. Because bags are unpredictably spaced along the bag assembly, the print area may extend over the end of one bag, resulting in partial printing on one bag and partial printing on another bag. Printing of date and source information on adjacent bags is unacceptable.

Accordingly, there is a need for an improved printer assembly for a bagger using shingled bags which reliably prints product information on areas of individual shingled bags independently of longitudinal spacing of the bags along the bag assembly. Additionally, there is a need for an improved method for printing information on areas of individual shingled bags independently of the longitudinal spacing of the bags in the bag assembly.

SUMMARY OF THE INVENTION

The invention is an improved bag printer assembly for printing information on areas of individual bags arranged in a shingled bag assembly without the printing extending unto an adjacent bag, independently of the longitudinal spacing of bags along the assembly. The bag printer assembly individually senses the location of a bag in the assembly, stops the feed of the assembly past the printer with a bag to be printed located in position to be printed. All required information is printed on the bag. Printing does not extend onto an adjacent bag. A printer assembly moves an overlying downstream bag away from the assembly to actuate a sensor which stops feed of the bag assembly with the print area of the underlying bag in position to be printed.

Other objects and features of the invention will become apparent as the description proceeds, especially when taken in conjunction with the accompanying drawings illustrating the invention, of which there are five sheets of drawings and two embodiments.

DESCRIPTION OF THE DRAWINGS

FIG. 4 is a view of overlapped or shingled bags in a bag assembly with a print area;

FIG. 5 is a side view of FIG. 4;

FIGS. 6 and 7 are views like FIG. 4 with different print areas; and

DESCRIPTION OF THE PREFERRED EMBODIMENTS

Figure 1:
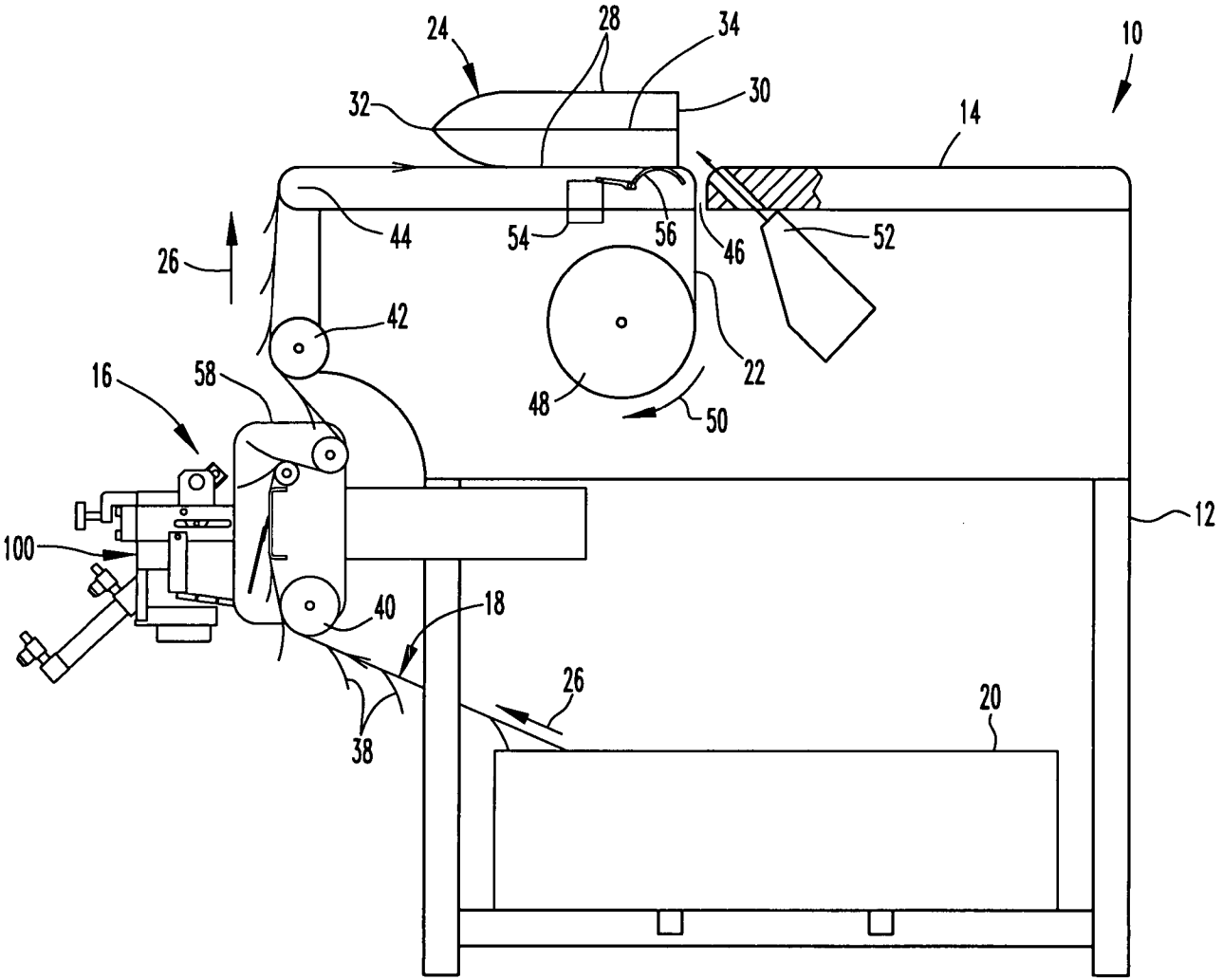
FIG. 1 is a side view, partially broken away, of a bagger with a first embodiment printer assembly for shingled bags.

FIG. 1 illustrates bagger 10 having a frame 12, a workstation 14 at the top of the frame and a bag printer assembly 16 mounted on one side of frame 12. An indefinite length shingled bag assembly 18 is fed from box 20 mounted on the bottom of frame 12, through printer assembly 16 and to station 14. The printer assembly prints desired information, typically date and source information, on each bag in the bag assembly.

FIGS. 4, 6 and 7 illustrate portions of assembly 18. The assembly includes two spaced, parallel indefinite length adhesive strips 22. A plurality of generally rectangular shingled plastic bags 24 are adhered to strips 22. The assembly 18 is fed from box 20 to station 14 downstream in the direction of arrow 26.

Each bag 24 is made from thin plastic film and has opposed rectangular sides 28 (See FIG. 1), an open lead end 30, sealed trailing end 32 and sealed edges 34 extending between ends 30 and 32. Each bag extends a distance L along assembly 18, as measured between ends 30 and 32. FIG. 5 illustrates that a lead portion 36 of each bag side 28 adjacent strips 22 is adhered to the strips to hold the bags in the bag assembly. Portions 36 extend a short distance from lead bag ends 30 toward trailing bag ends 32 and are continuous along the assembly. The trailing portions 38 of the bags are shingled or overlie each other, as shown in FIG. 5, and are not joined to strips 22. The trailing portions 38 may have a length along the assembly considerably greater than the length of adhered lead portions 36.

As shown in FIG. 1, bag assembly 18 is fed from box 20 to printer assembly 16 with strips 22 on the top of the bag assembly and bag upstream trailing portions 38 hanging down from the bottom of the assembly. The bag assembly is fed around lower roller 40, through printer assembly 16, around upper roller 42, around the rounded edge 44 of workstation 14 and to a slot or slots 46 extending through the workstation. Strips 22 extend through the slots 46 and are wound on reel 48. A drive motor (not illustrated) rotates reel 48 in the direction of arrow 50 to feed assembly 18 from box 20, through printer assembly 16 and to station 14.

Bagger 10 includes an air nozzle 52 located below station 14. The nozzle is connected to a source of compressed air. During operation of the bagger, the nozzle 52 continuously blows compressed air through an opening in station 14 toward the open lead end of each bag 24. The air blast from nozzle 52 inflates the lead bag, as illustrated in FIG. 1, to permit an operator to insert an article to be packaged within the open bag and then remove the article and bag from strips 22. The bag is then sealed closed. If desired, air in the bag may be removed to vacuum pack the article.

Micro-switch 54 is mounted on workstation 14 and includes a trigger 56 normally extending above the surface of station 14. The trigger is moved down by the lead end 30 of each bag 24 fed to the load position on station 14, as illustrated. Movement of the trigger actuates switch 54.

Figure 2:
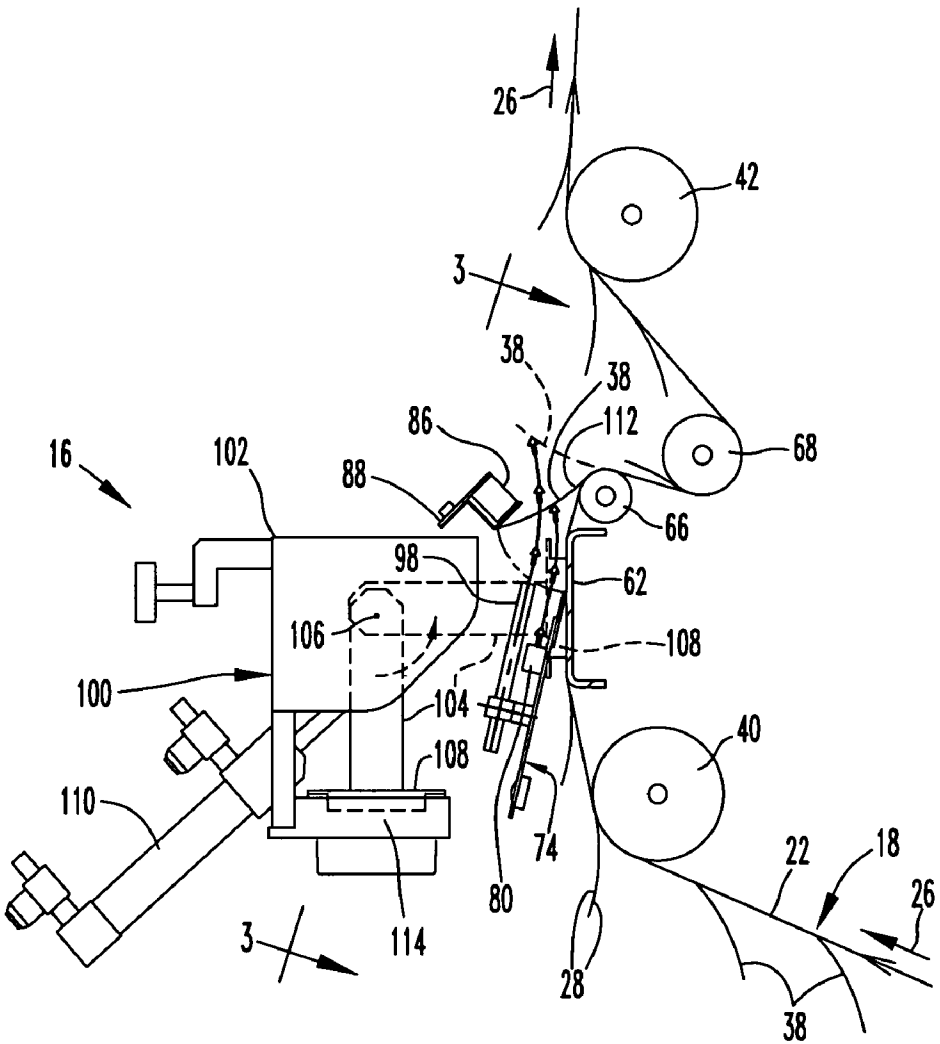
FIG. 2 is an enlarged view of the printer assembly shown in FIG. 1.
Figure 3:
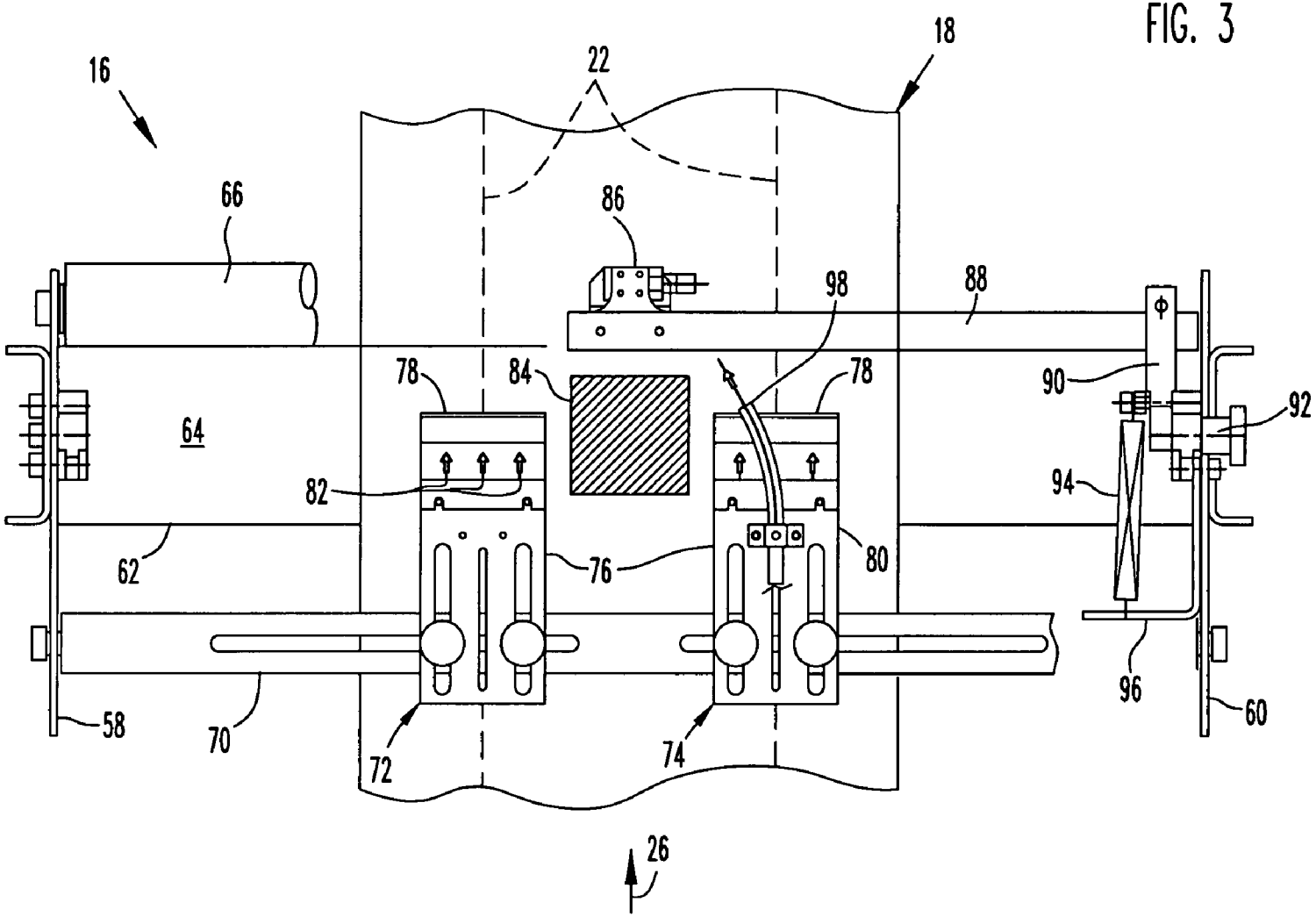
FIG. 3 is a sectional view, partially broken away, taken generally along line 3—3 of FIG. 2.

Printer assembly 16 is illustrated in FIGS. 2 and 3. The assembly includes two spaced, parallel mounting plates 58 and 60 supported on frame 12 and extending to one side of the frame as illustrated in FIG. 1. Support plate or member 62 is mounted on and extends between plates 58 and 60 to define a flat print support surface 64 facing away from frame 12. Small diameter roller 66 extends between plates 58 and 60 at the upper edge of plate 62. Roller 66 is located a short distance inwardly from or below surface 64. Direction reversal roller 68 is also mounted between plates 58 and 60 a distance further below support surface 64 and a distance above roller 66.

Holddown support 70 is mounted on plates 58 and 60 and extends between the plates above plate 62. Two like bag assembly holddowns 72, 74 are mounted on support 70 and angle from the support toward surface 64 on plate 62. Each holddown includes a plate 76 mounted on support 70 which angles down toward plate 62 and has a lead end 78 located away from support 70 and spaced a short distance above surface 64. The spacing between holddown ends 78 and surface 64 is sufficient to permit free movement of bag assembly 18 between the holddowns and the support surface without injury to the shingled bags. The holddowns prevent premature flip up of trailing bag portions 38.

A nozzle block 80 is mounted on the side of each holddown plate 76 away from plate 62 and a short distance inwardly from plate end 78. Each block 80 includes three air nozzles 82 aimed downwardly along the plate 76, past ends 78 and toward the surface of bag assembly 18 being fed past the holddowns and along surface 64. Nozzles 82 are connected to a source of compressed air during operation of bagger 10 to continuously flow jets of air onto the bag assembly. Each holddown 72, 74 is located adjacent one edge of bag assembly 18 and to one side of a central rectangular print area 84 located on surface 64 and downstream from holddown lead ends 78.

Electronic bag sensor 86, a motion detector, is positioned over the center of support plate 62 a short distance downstream from the holddowns. Sensor 86 is mounted on support arm 88 which is in turn mounted on the outer end of radial arm 90. The inner end of arm 90 is rotatably mounted on post 92 on plate 60. The arm 90 rotates between two over-center positions to move bag sensor 86 from an operative position illustrated in FIGS. 2 and 3 to a position away from plate 62 (not illustrated) to facilitate feeding of assembly 18 through the printer assembly 16. Spring 94 extends between arm 90 and bracket 96 on plate 60 to hold the sensor 86 in either of the two over-center positions.

Intermittent air blast nozzle 98 is mounted on holddown 74 and is aimed to direct an air blast at the area between plate 62 and sensor 86. See FIG. 2. Nozzle 98 is connected to a source of compressed air through a solenoid control valve which is activated to flow air through the nozzle as described below.

Assembly 16 includes a stamp printer 100 for printing information on a print area 84 on each bag in the bag assembly fed through the print assembly. Printer 100 includes a printer frame 102 mounted on frame 12. Print swing arm 104 is mounted on frame 102 for rotation about horizontal axis 106 between the two positions shown in FIG. 2. Print head 108 is mounted on the outer end of arm 104. Air cylinder 110 is mounted on frame 102. The piston rod of the cylinder is connected to arm 104 so that The pension of the cylinder moves the arm from the vertical position to the horizontal position, as shown in FIG. 2. Retraction of the cylinder returns the arm to the vertical position. When the arm is in the vertical, retracted print head 108 is adjacent inkpad 114 and when the arm is in the horizontal position the head is adjacent the center of support surface 64, above print area 84. The printer includes a drive for extending the print head outwardly of the arm and, depending upon the position of the arm, engaging the inkpad or engaging and printing one side of a bag on surface 64 at print area 84.

The operation of bagger 10 will now be described. An indefinite length of bag assembly 18 is folded in box 10 so when a length of the assembly is pulled from the box toward ter assembly 16, as illustrated in FIG. 1, adhesive strips 22 on the upper side of the assembly, and plastic bags 24 are on lower side of the assembly with the lead bag portions 36 adhered to strips 22 and the shingled trailing bag portions 38 extending rearwardly or upstream along the assembly 18 free from the strips. The lead portions 36 are adjacent each other along the length of the bag assembly, as illustrated in FIG. 4.

The lead end of the bag assembly is fed around roller 40, onto support plate 62 and under holddowns 72 and 74. The lead end is then fed around rollers 66, 68 and 42, as shown in FIG. 2, around workstation edge 44 and the station to openings 46. The bags at the end of the assembly extending past printer assembly 16 are stripped away and the two adhesive strips 22 are attached to reel 48 so that rotation of the reel 48 by the drive motor in the direction of arrow 50 feeds the bag assembly 18 from box 20 past printer assembly 16 and to station 14 in the direction of arrow 26. The bag assembly 18 is moved past printer assembly 16 with strips 22 facing print support surface 64 and shingled plastic bags 24 facing away from surface 64. Rollers 40 and 66 are located below or to one side of surface 64 to assure the bag assembly is held flush on the surface, as illustrated. Strips 22 and lead bag portions 36 are fed across surface 64. The trailing bag portions 38 face away from the surface and do not engage the surface.

The control circuitry for bagger 10 activate the motor to rotate reel 48 and feed bag assembly 18 downstream until the lead portion 36 of a bag 24 on strips 22 engages trigger 56 to actuate micro-switch 54 and stop rotation of the reel 48 and feeding of the assembly. The air blast from nozzle 52 inflates the bag as shown in FIG. 1 so that an operator may place an article in the bag and then remove the bag and article from strips 22. The bag is then sealed conventionally.

Removal of the bag from strips 22 releases trigger 56 to actuate switch 54 and initiate feeding of the next bag on assembly 18 to the load position shown in FIG. 1.

Bag printer assembly 16 prints every bag in assembly 18. Feeding of the bag assembly 18 by reel 48 moves the each bag across support plate 62 and under the ends 78 of holddowns 72 and 74. The bags are adhered to strips 22 and move downstream in the direction of arrow 26 with the strips. The holddowns assure that the shingled trailing portion 38 of each bag is held on the support assembly as the bag is moved across the surface 64 despite continuous downstream air jets from nozzles 82. These jets are aimed toward surface 64 and against the side of trailing bag portion 38 facing away from surface 64.

Continued downstream movement of the bag assembly in the direction of arrow 26 moves the sealed trailing end 32 of a bag 24 past the ends 78 of the holddowns so that the trailing portion 38 of the bag is no longer held on surface 64 and on the assembly. The downwardly angled air jets from nozzles 82 flow under the freed trailing portion 38 and flip up or rotate the portion away from surface 64 and other bags in the bag assembly held on the surface. The trailing portion is rotated up about hinge 112 at the junction between the trailing portion 38 and the lead portion 36 adhered to strips 22. The trailing portion is moved up by the jets from nozzles 82 during downstream movement of the bag assembly.

Bags 24 are typically formed by heat-sealing together two plastic films. Heat sealing of the closed, trailing end 32 of the bag may scallop the bag at the seal, forming pockets between the end of the bag and the underlying bag in assembly 18. The pockets are flattened by holddowns 72 and 74. However, when the trailing end of a bag passes the holddowns the scallops reform, providing air pockets between the trailing end of the bag and the underlying bag. The air jets from nozzles 82 fill the pockets to facilitate moving of the trailing bag portion 38 away from surface 64.

Lifting up of trailing bag portion 38, as shown in FIG. 2, moves portion 38 sufficiently close to bag sensor 86 to actuate the sensor. Actuation of the sensor 86 deactivates the motor rotating reel 48 for an interval of time sufficient for printer 100 to print the bag on surface 64 underlying the bag which actuated the sensor. During this interval the bag assembly 18 does not move across plate 62.

Additionally, actuation of sensor 86 activates the solenoid in the air pressure line for blast nozzle 98 for an interval sufficiently long to direct a high-pressure blast of air from the nozzle against the lifted bag trailing portion 38 to blow the portion 38 about hinge 112 to the dashed position shown in FIG. 2, past the sensor and away from the printer.

Actuation of the sensor also activates printer 100 to move print head 108 from inking pad 114 to above the underlying bag on print support surface 64 and print the exposed bag surface on the underlying bag. After printing, the printer returns the head to pad 114. The disclosed printer prints a bag in approximately 0.2 seconds. After printing, the timing cycle expires and the motor for reel 48 is again activated to feed the bag assembly 18 in the direction of arrow 26 until the next lead bag engages trigger 56, actuates switch 54 to start another cycle of operation. The flipped up portion 38 is rotated back to assembly 18. The printer assembly interrupts feeding of the bag assembly to workstation 14 to print each shingled bag.

FIGS. 4, 6 and 7 illustrate that the location of print area 84 on the outer side of the trailing portion of each bag underlying flipped bag may be adjusted as required. In FIG. 4, print area 84 is located on the underlying bag and extends to either side of the closed trailing end of the overlying bag when returned from the flipped up position to the shingled position. This print area can be longer than the print area of FIGS. 6 and 7.

In FIG. 6, print area 84 is located on the normally exposed portion of the underlying bag, adjacent the trailing end 32 of the underlying bag.

In FIG. 7, print area 84 is located on the underlying bag, entirely under the trailing portion of the overlying bag.

The location of print area 84 is varied by moving the lead ends 78 of holddowns 72 and 74 upstream or downstream on plate 62 to adjust the position of the underlying bag when the trailing portion of the overlying bag is flipped up to actuate sensor 86, stop feed of bag assembly 18 and initiate the print cycle.

Roller 66 has a small diameter to assure that the hinge 112 for the flipped trailing portion 38 blown past sensor 86 is located on the side of the roller facing away from plate 62. Location of the hinge away from the plate facilitates blowing the trailing portion past the sensor by the air blast from nozzle 98. Roller 68 is located below, or to the right of a line extending between the centers of rollers 66 and 42, in order to wind the bag assembly 18 around roller 66 and facilitate blowing bag trailing portion 38 past sensor 86.

Figure 8:
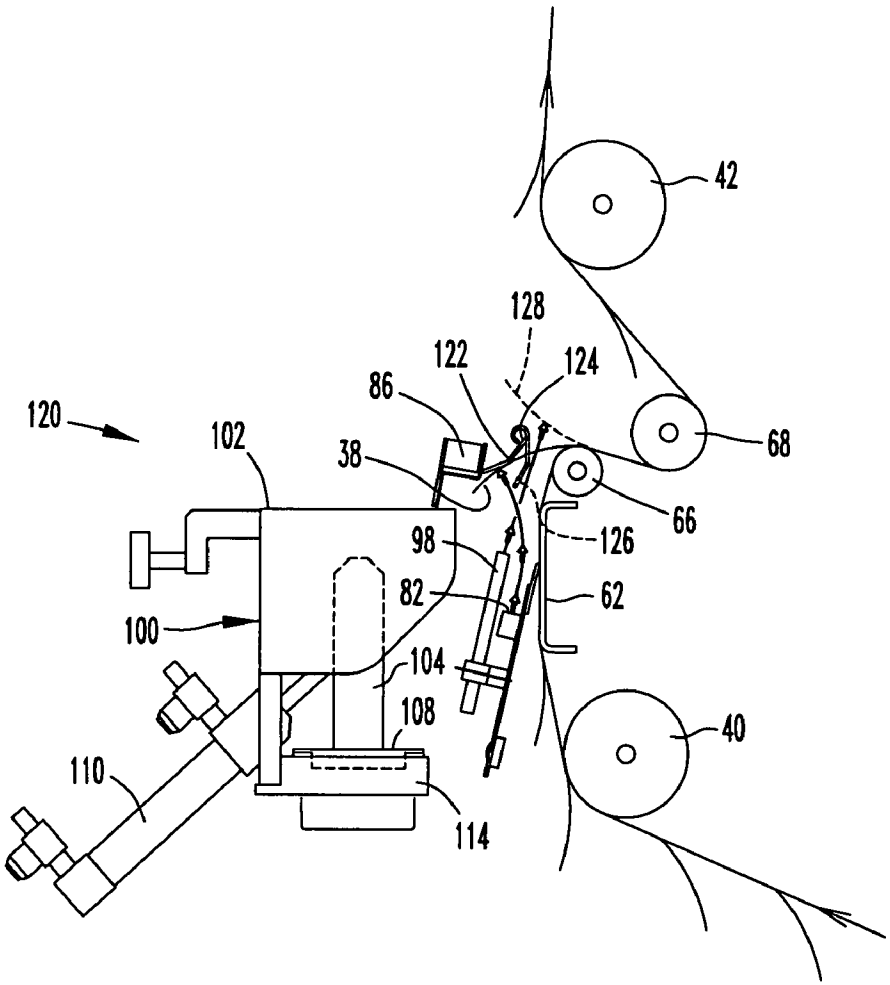
FIG. 8 is a view similar to FIG. 2 illustrating a second embodiment printer assembly.

FIG. 8 illustrates a second embodiment bag printer assembly 120 used in bagger 10 in place of assembly 16. Assembly 120 is similar to assembly 16 and uses components used in assembly 16. Reference numbers used in FIGS. 1–3 are used in FIG. 8 to describe components identical to the previously described components.

Assembly 120 is identical to assembly 16 with the exception that a lightweight trigger member 122 is pivotally suspended on a support 124 located a short distance above sensor 86 and between the sensor and roller 66. The trigger member is suspended freely in the space between the sensor and the roller.

Print assembly 120 operates like assembly 16 with the exception that when the air jets from nozzles 82 flip up a bag trailing portion 38 the portion 38 hits trigger 122 located in the dashed position 126 shown in FIG. 8. The flipped up bag portion 38 rotates the trigger toward the sensor and actuates the sensor to initiate the print cycle as previously described. The air blast from nozzle 98 blows the trailing portion 38 of the bag past the trigger to the dashed position 128 shown in FIG. 8 allowing the trigger member to return to position 126 for engagement by the next trailing portion blown up by the air jets from nozzle 82.

Trigger member 122 may be a thin metal or plastic plate with sufficient mass to reliably actuate sensor 86 when moved adjacent sensor 86. The lower end of trigger 186 extends toward sensor 86 when in position 126 so that the air blast from nozzle 98 does not displace the trigger.

Both bag printer assemblies 16 and 120 use stamp printers 100 having a printer head, an inking pad and a drive for moving the head between the pad and print area 84. Other types of printers may be used. For instance, an ink jet printer may be used. This type of printer includes a print head located over print area 84. The print head is actuated to print the bag information on the print area on an underlying bag after the trailing portion of an underlying bag has been flipped up from the bag assembly and feed of the assembly has been stopped, as described. Printers are located between holddowns 72 and 74. Printing is not affected by air jets from nozzles 82.

The disclosed print assemblies assure that information is printed on a print area for each bag in the bag assembly, independently of the location of the bag along the assembly. Bags are not uniformly spaced along assembly 18. The printer assemblies sense the location of each bag in assembly 18 by flipping up the trailing portion of a bag immediately after the end has moved past holddowns 72, 74 and then stopping feeding of the bag assembly. Stopping the bag assembly at a known position relative to the position of the flipped up bag assures that the underlying bag is at a desired location on the surface 64 for printing.

The trailing portions 38 of bags 24 are flipped up by a pressure differential across the portions. The air jets from nozzles 82 and 98 increase the pressure on the inner sides of the portions above atmospheric pressure. The difference in pressure flips the bag portions above the bag assembly as described. If desired, the trailing portions of the bags 24 may be flipped up by a pressure differential provided by reducing the pressure on the upper or outer sides of the portions. For instance, a vacuum port above the portions may be provided to reduce the pressure above the outer sides of the portions to flip the portions up as described. A moveable vacuum head may also be used to engage the outer portions of the bags and move the portions above the underlying bags.

Both disclosed bag printer assemblies 16 and 120 print information on bags in a shingled bag assembly by flipping up the trailing portion of an overlying bag and printing the underlying bag. The invention is not limited to printer assemblies which print information on shingled bag assemblies but includes machines including printer assemblies as disclosed which print information on individual members, or shingles arranged in an indefinite length shingle assembly where each shingle includes a lead portion joined to the assembly and a trailing portion overlapping a trailing shingle in the assembly. For instance, this type of shingle assembly could include a number of paper sheets with lead ends adhered to an indefinite length carrier and trailing ends extending from the lead ends over underlying pages.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention:

1. The method of printing product information on one side of plastic bags located in an indefinite length assembly of shingled bags where each bag has an open downstream end, a closed upstream end, a lead portion adhered to the assembly and a shingled trailing portion overlying an upstream bag, comprising the steps of:

A) feeding the bag assembly across a support member with the trailing portions of the bags on the side of the assembly away from the support member; and B) holding the trailing portion of each bag against an underlying bag in the assembly until the trailing end of the bag is in a known location and then, i) moving the trailing portion of the bag away from the support member and above an underlying bag, and ii) printing product information at a known location on the underlying bag.

2. The method of claim 1 including the step of:

C) blowing the trailing portion of each bag away from the support member.

3. The method of claim 1 including the step of:

C) vacuum moving the trailing portion of each bag away from the support member.

4. The method of claim 1 including the step of:

C) moving the trailing portion of each bag adjacent a sensor to actuate the printing step.

5. The method of claim 1 including the step of:

C) stopping feeding of the bag assembly across the support member prior to printing.

6. The method of claim 1 including the step of:

C) blowing the trailing portion of each bag toward a sensor to actuate the sensor, stop feeding of the bag assembly across the support member and initiating printing; and D) blowing the trailing end of each bag away from the sensor after the sensor has been actuated.

7. The method of claim 1 including the step of:

C) moving the trailing portion of each bag back to the assembly after printing.

8. The method of printing information on one side of a underlying shingle in an indefinite length shingle assembly where each shingle has a lead portion attached to the assembly and a trailing portion overlying another shingle, comprising the steps of:

A) feeding the assembly longitudinally across a support member with trailing portions of the shingles on the side of the assembly away from the support member and extending upstream;

B) moving the trailing portion of a first shingle away from the support member to expose an underlying shingle when the first shingle is at a known location on the support member; and C) printing information at a desired location on the side of the underlying shingle facing away from the support member.

9. The method of claim 8 including the step of:

D) providing a pressure differential across the trailing portion of the first shingle to move the trailing portion away from the support member.

10. The method of claim 8 including the step of:

D) blowing the trailing portion of the first shingle away from the support member.

11. The method of claim 8 including the step of:

D) vacuum drawing the trailing portion of the first shingle away from the support member.

12. The method of claim 8 including the step of:

D) holding the trailing portion of the first shingle adjacent to the underlying shingle prior to performing step B).

13. The method of claim 8 including the step of:

D) stopping longitudinal feeding of the shingle assembly prior to printing.

14. The method of claim 13 including the step of:

D) returning the trailing portion of the first shingle to the assembly after printing.

* * * * *